US011443879B2

(12) United States Patent
Wang et al.

(10) Patent No.: US 11,443,879 B2
(45) Date of Patent: Sep. 13, 2022

(54) MAGNETIC CORE FOR INTEGRATED MAGNETIC DEVICES

(71) Applicant: TEXAS INSTRUMENTS INCORPORATED, Dallas, TX (US)

(72) Inventors: Fuchao Wang, Plano, TX (US); Yousong Zhang, Dallas, TX (US); Neal Thomas Murphy, Fairview, TX (US); Brian Zinn, Lucas, TX (US); Jonathan P. Davis, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 271 days.

(21) Appl. No.: 16/512,642

(22) Filed: Jul. 16, 2019

(65) Prior Publication Data

US 2019/0341181 A1 Nov. 7, 2019

Related U.S. Application Data

(62) Division of application No. 15/618,353, filed on Jun. 9, 2017, now Pat. No. 10,403,424.

(51) Int. Cl.

| | |
|---|---|
| ***H01F 10/00*** | (2006.01) |
| ***H01F 10/30*** | (2006.01) |
| ***H01F 17/00*** | (2006.01) |
| ***H01F 41/04*** | (2006.01) |
| ***H01F 27/24*** | (2006.01) |

(52) U.S. Cl.

CPC ..... *H01F 10/30* (2013.01); *H01F 17/0033* (2013.01); *H01F 27/24* (2013.01); *H01F 41/046* (2013.01)

(58) Field of Classification Search

CPC ..... H01F 17/0033; H01F 10/30; H01F 41/04; H01F 27/24

See application file for complete search history.

(56) References Cited

U.S. PATENT DOCUMENTS

| | | | | |
|---|---|---|---|---|
| 6,198,597 | B1 | 3/2001 | Tateyama et al. | |
| 6,413,788 | B1 * | 7/2002 | Tuttle | B82Y 10/00 438/3 |
| 6,475,812 | B2 | 11/2002 | Nickel et al. | |
| 6,870,456 | B2 | 3/2005 | Gardner | |

(Continued)

FOREIGN PATENT DOCUMENTS

| | | |
|---|---|---|
| JP | 2008021816 A | 1/2008 |
| JP | 2010027150 A | 2/2010 |

*Primary Examiner* — Paul D Kim

(74) *Attorney, Agent, or Firm* — Andrew R. Ralston; Charles A. Brill; Frank D. Cimino

(57) ABSTRACT

An integrated magnetic device has a magnetic core which includes layers of the magnetic material located in a trench in a dielectric layer. The magnetic material layers are flat and parallel to a bottom of the trench, and do not extend upward along sides of the trench. The integrated magnetic device is formed by forming layers of the magnetic material over the dielectric layer and extending into the trench. A protective layer is formed over the magnetic material layers. The magnetic material layers are removed from over the dielectric layer, leaving the magnetic material layers and a portion of the protective layer in the trench. The magnetic material layers along sides of the trench are subsequently removed. The magnetic material layers along the bottom of the trench provide the magnetic core.

23 Claims, 17 Drawing Sheets

FIG. 1B

(56) References Cited

U.S. PATENT DOCUMENTS

| | | | | |
|---|---|---|---|---|
| 6,912,770 | B2 | 7/2005 | Lee | |
| 6,916,669 | B2 | 7/2005 | Jones et al. | |
| 6,920,022 | B1 | 7/2005 | Tsuchiya et al. | |
| 7,119,976 | B2 | 10/2006 | Biskeborn et al. | |
| 7,719,084 | B2 | 5/2010 | Gardner et al. | |
| 8,110,085 | B2 | 2/2012 | Hsiao et al. | |
| 8,213,132 | B2 | 7/2012 | Heim et al. | |
| 8,262,919 | B1 | 9/2012 | Luo et al. | |
| 8,273,582 | B2 | 9/2012 | Nozieres et al. | |
| 8,395,381 | B2 | 3/2013 | Lo et al. | |
| 8,451,563 | B1 | 5/2013 | Zhang et al. | |
| 8,454,846 | B1 | 6/2013 | Zhou et al. | |
| 8,470,612 | B2 | 6/2013 | Hofmann et al. | |
| 8,578,594 | B2 | 11/2013 | Jiang et al. | |
| 8,680,592 | B2 | 3/2014 | Li | |
| 8,786,987 | B2 | 7/2014 | Edelman et al. | |
| 8,914,969 | B1 | 12/2014 | Zhou et al. | |
| 9,048,128 | B2 * | 6/2015 | Tseng | H01F 27/24 |
| 9,346,672 | B1 | 5/2016 | Zhang | |
| 9,349,394 | B1 | 5/2016 | Sun et al. | |
| 9,450,178 | B2 | 9/2016 | Xu et al. | |
| 9,865,389 | B2 | 1/2018 | Tseng et al. | |
| 2007/0247752 | A1 * | 10/2007 | Otagiri | G11B 5/1278<br>360/125.03 |
| 2010/0219156 | A1 | 9/2010 | Hipwell, Jr. et al. | |
| 2014/0001585 | A1 | 1/2014 | Dmitrov et al. | |
| 2014/0104288 | A1 | 4/2014 | Shenoy et al. | |
| 2016/0155935 | A1 * | 6/2016 | Eissa | G01R 33/04<br>438/48 |
| 2017/0346000 | A1 * | 11/2017 | Eissa | H01L 43/12 |

* cited by examiner

MAGNETIC CORE FOR INTEGRATED MAGNETIC DEVICES

CROSS REFERENCE TO RELATED APPLICATIONS

Under 35 U.S.C. §§ 119(e), 120, 121, this divisional application claims priority to and benefits of U.S. patent application Ser. No. 15/618,353, filed on Jun. 9, 2017, now U.S. Pat. No. 10,403,424, entirety of which is hereby incorporated herein by reference.

FIELD

This disclosure relates to the field of integrated magnetic devices. More particularly, this disclosure relates to magnetic cores in integrated magnetic devices.

BACKGROUND

A magnetic core of an integrated magnetic device frequently includes magnetic material layers such as permalloy layers alternated with barrier layers of a non-magnetic barrier material. In some cases, this layer stack may be formed on a planar surface and patterned using an etch mask and a wet etch, which undesirably undercuts the etch mask and produces poor dimensional and profile control. Stress in the magnetic material is difficult to control in such a configuration, and can lead to degraded performance of the integrated magnetic device, for example Barkhausen noise. In other cases, this layer stack may be formed in a trench in a dielectric layer. The magnetic material layers conform to contours of the trench, resulting in a non-planar configuration which also leads to degraded performance of the integrated magnetic device.

SUMMARY

The present disclosure introduces a system and a method for forming a magnetic core in a trench of a dielectric layer. In one implementation, the disclosed system/method involves removing layers of magnetic material from sidewalls of the trench. Advantageously, the removal step reduces defects in the magnetic core.

An integrated magnetic device has a magnetic core which includes magnetic material layers located in a trench in a dielectric layer. The magnetic material layers are flat and parallel to a bottom of the trench, and do not extend upward along sides of the trench. The integrated magnetic device is formed by forming the magnetic material layers over the dielectric layer and extending into the trench, so that each layer extends along a bottom of the trench and upward along sides of the trench. A protective layer is formed over the magnetic material layers. The magnetic material layers are removed from over the dielectric layer, leaving the magnetic material layers and a portion of the protective layer in the trench. The magnetic material layers along sides of the trench are subsequently removed, while the magnetic material layers along the bottom of the trench are protected by the protective layer. The magnetic material layers along the bottom of the trench provide the magnetic core.

DETAILED DESCRIPTION

The present disclosure is described with reference to the attached figures. The figures are not drawn to scale and they are provided merely to illustrate the disclosure. Several aspects of the disclosure are described below with reference to example applications for illustration. It should be understood that numerous specific details, relationships, and methods are set forth to provide an understanding of the disclosure. The present disclosure is not limited by the illustrated ordering of acts or events, as some acts may occur in different orders and/or concurrently with other acts or events. Furthermore, not all illustrated acts or events are required to implement a methodology in accordance with the present disclosure.

For the purposes of this disclosure, the term "instant top surface" of an integrated magnetic device is understood to refer to a top surface of the integrated magnetic device which exists at the particular step being disclosed. The instant top surface may change location from step to step in the formation of the integrated magnetic device. For the purposes of this disclosure, the term "vertical" is understood to refer to a direction perpendicular to the plane of the instant top surface of the integrated magnetic device.

It is noted that terms such as upper, lower, over, above, under, and below may be used in this disclosure. These terms should not be construed as limiting the position or orientation of a structure or element, but should be used to provide spatial relationship between structures or elements. For the purposes of this disclosure, it will be understood that, if an element is referred to as being "along" to another element, it may be contacting the other element, or intervening elements may be present.

Figure 1A:
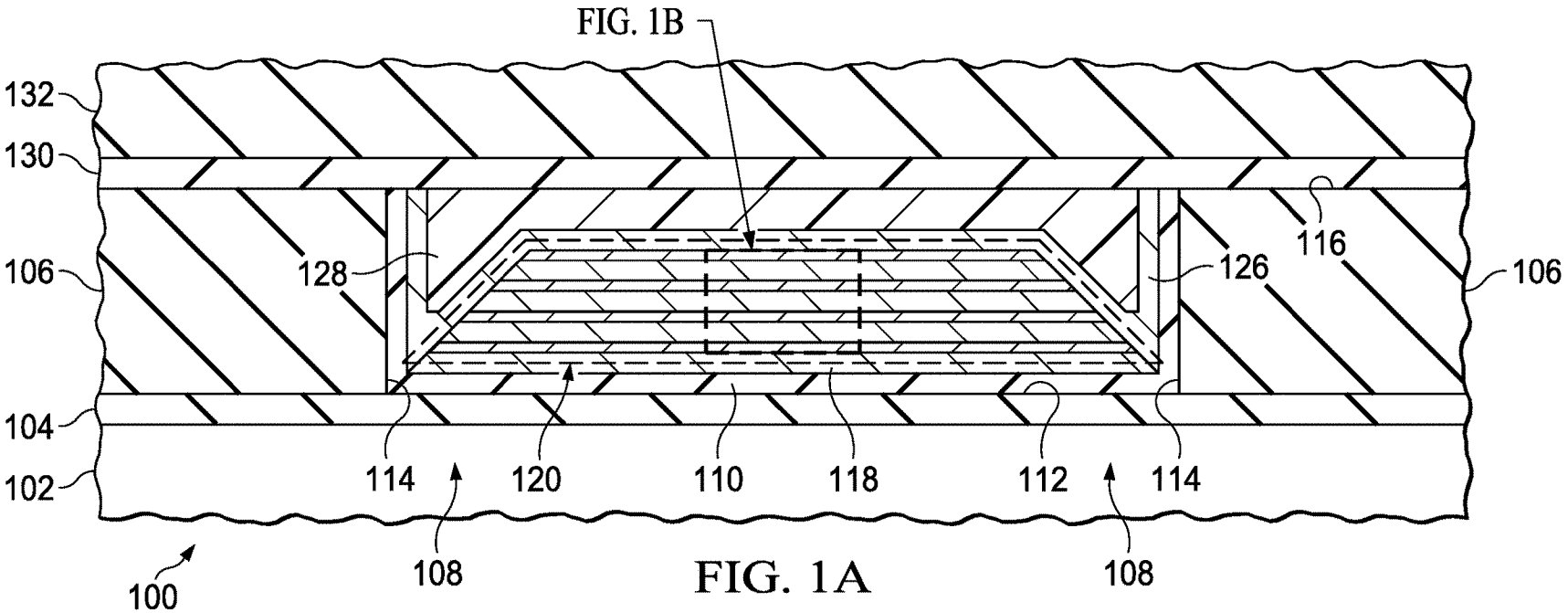
FIGS. 1A and 1B are cross sections of an example integrated magnetic device.
Figure 1B:
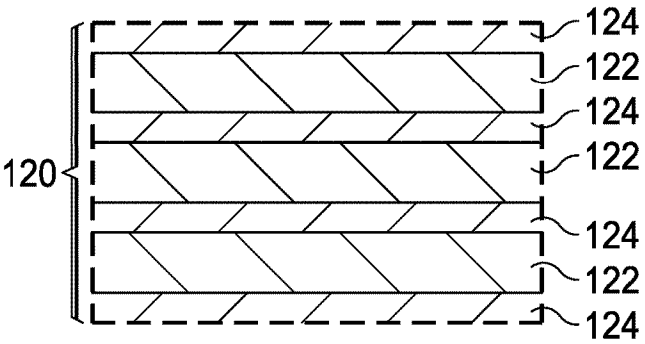

FIG. 1A and FIG. 1B are cross sections of an example integrated magnetic device. Referring to FIG. 1A, the integrated magnetic device 100 includes a substrate 102. The substrate 102 may include, for example, active components such as transistors, passive components such as resistors and capacitors, and interconnection members such as vias and interconnects. An optional trench stop layer 104 may be located over the substrate 102. The trench stop layer 104 may include, for example, one or more layers of silicon nitride, silicon oxynitride, silicon carbide, or other material having a low etch rate in processes used to remove silicon dioxide-based dielectric material, located over the substrate 102. A core dielectric layer 106 is located over the substrate 102, on the optional trench stop layer 104, if present. The core dielectric layer 106 may include, for example, silicon dioxide or silicon dioxide-based dielectric material such as a low-k dielectric material. A trench structure 108 extends through the core dielectric layer 106, to the optional trench stop layer 104, if present. The trench structure 108 has a bottom 112 along the substrate 102 and has sides 114 extending from the bottom 112 to a top surface 116 of the core dielectric layer 106. The sides 114 are depicted in FIG. 1A as straight and vertical, that is perpendicular to the bottom 112. Other shapes for the trench structure 108 are within the scope of the instant example. The sides 114 may be sloped, or curved, depending on how the trench structure 108 is formed. An optional trench barrier liner 110 may be located along the bottom 112 and the sides 114 of the trench structure 108. The trench barrier liner 110 may include silicon nitride, silicon oxynitride, or other material suitable for reducing diffusion of metals into the core dielectric layer 106.

A lower encapsulation layer 118 may be located along the bottom 112 of the trench structure 108. The lower encapsulation layer 118 may include one or more layers of titanium, titanium nitride, tantalum, tantalum nitride, or other material suitable for controlling stress in a magnetic core 120, in any combination thereof. The lower encapsulation layer 118 extends along the bottom 112 of the trench structure 108. The lower encapsulation layer 118 may be confined to the bottom 112 of the trench structure 108, as depicted in FIG. 1A, or may extend upward along the sides 114 of the trench structure 108. The magnetic core 120 is located on the lower encapsulation layer 118. The magnetic core 120, which is shown in detail in FIG. 1B, includes magnetic material layers 122. The magnetic material layers 122 in the magnetic core 120 are flat and parallel to the bottom 112 of the trench structure 108. The magnetic material layers 122 may include, for example, an alloy of iron, nickel, cobalt, or any combination thereof. The magnetic material layers 122 may also include aluminum, silicon, molybdenum, chromium, niobium, or vanadium. Other materials for the magnetic material layers 122 are within the scope of the instant example. In the instant example, the magnetic material layers 122 may be separated by barrier layers 124 of a barrier material, for example a III-N material such as aluminum nitride or other electrically isolating material with etch characteristics similar to the magnetic material layers 122. III-N materials have one or more group III elements, that is, boron, aluminum, or gallium, combined with nitrogen. The magnetic material layers 122 do not extend upward along the sides 114 of the trench structure 108. An upper encapsulation layer 126 is located over the magnetic core 120, and may extend upward along the sides 114, as depicted in FIG. 1A. The upper encapsulation layer 126 may include one or more layers of material suitable for controlling stress in the magnetic material layers 122. The upper encapsulation layer 126 may have a composition and structure similar to the lower encapsulation layer 118. The magnetic material layers 122 do not extend past the top surface 116 of the core dielectric layer 106. An optional trench fill material 128 may be located over the upper encapsulation layer 126, filling the trench structure 108. The trench fill material 128 may include, for example, one or more layers of silicon dioxide, silicon nitride, or any combination thereof. The magnetic core 120 being located in the trench structure 108 and being confined by a combination of the lower encapsulation layer 118 and the upper encapsulation layer 126, may control stress in the magnetic material layers 122 and thus advantageously improve performance of the integrated magnetic device 100.

An optional interconnect etch stop layer 130 may be located over the top surface 116 of the core dielectric layer 106 and over the trench fill material 128. The interconnect etch stop layer 130 may include silicon nitride, silicon oxynitride, silicon carbide, or other material suitable for an etch stop in forming interconnects or vias. An upper dielectric layer 132, including silicon dioxide or silicon dioxide-based dielectric material, may be located over the interconnect etch stop layer 130. Windings, not shown in FIG. 1A, may be located around the magnetic core 120. The windings may include, for example, lower winding segments in the substrate under the magnetic core 120, side winding segments in the core dielectric layer 106 connecting to the lower winding segments, and upper winding segments in the upper dielectric layer 132 connecting to the side winding segments.

Figure 2A:
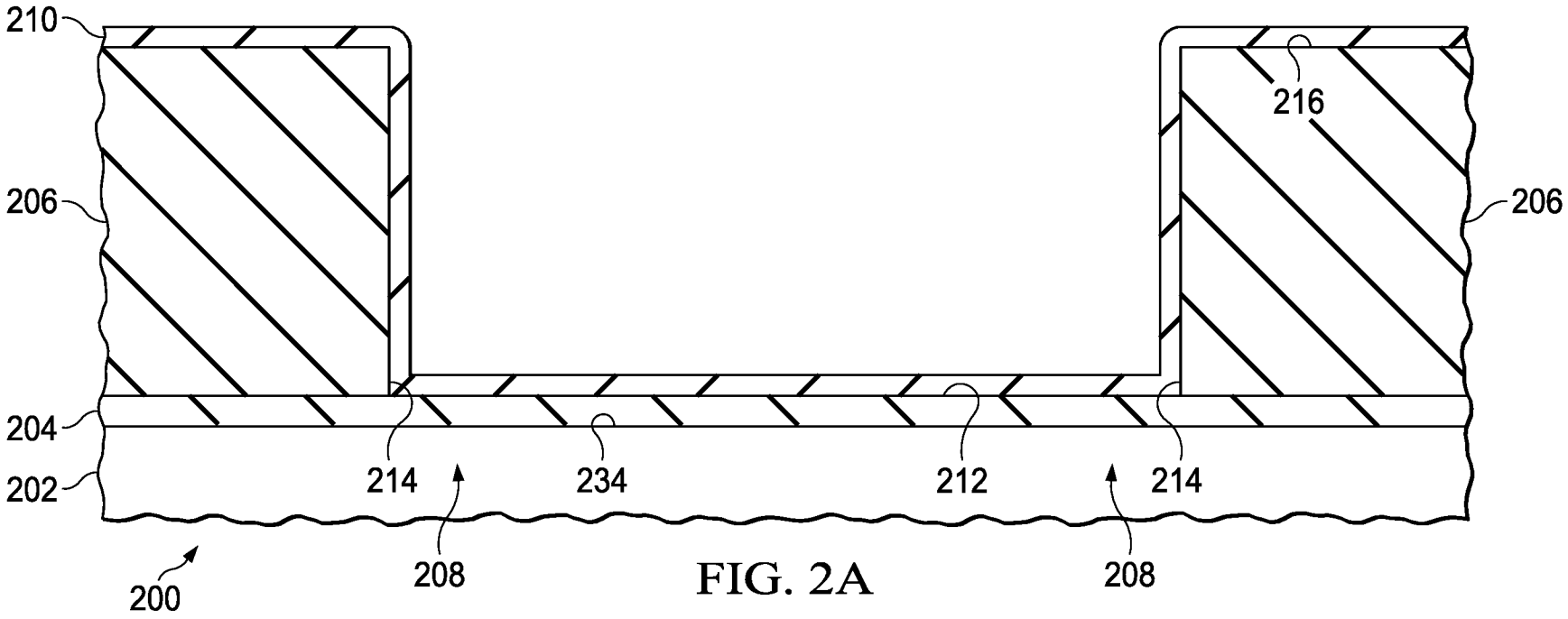
FIGS. 2A through 2G are cross sections of an integrated magnetic device having a magnetic core located in a trench, depicted in successive stages of an example method of formation.

FIG. 2A through FIG. 2G are cross sections of an integrated magnetic device having a magnetic core located in a trench, depicted in successive stages of an example method of formation. Referring to FIG. 2A, the integrated magnetic device 200 has a substrate 202 which may be, for example, part of a semiconductor wafer containing active components and circuits for operation of the integrated magnetic device 200. The substrate 202 may have dielectric material extending to a top surface 234. Vias or interconnects, not shown in FIG. 2A, may also extend to the top surface 234. An optional trench etch stop layer 204 may be formed over the top surface 234 of the substrate 202. The trench etch stop layer 204 may include, in one example, silicon nitride formed by a plasma enhanced chemical vapor deposition (PECVD) process using silane ($SiH_4$) and ammonia ($NH_3$), or by a PECVD process using bis(tertiary-butyl-amino) silane (BTBAS). In another example, the trench etch stop layer 204 may include silicon oxynitride formed by a PECVD process using silane, ammonia and nitrous oxide ($N_2O$). In a further example, the trench etch stop layer 204 may include silicon carbide formed by a PECVD process using silane and methane ($CH_4$).

A core dielectric layer 206 is formed over the trench etch stop layer 204. The core dielectric layer 206 may include silicon dioxide, formed by a PECVD process using tetraethyl orthosilicate (TEOS), or may include silicon dioxide-based dielectric material such as organosilicate glass (OSG) formed by a PECVD process. Other dielectric materials for the core dielectric layer 206 are within the scope of the instant example. The core dielectric layer 206 is thicker than the subsequently-formed magnetic core 220 shown in FIG. 2E below.

A trench 208 is formed through the core dielectric layer 206, extending to the trench etch stop layer 204 as depicted in FIG. 2A. The trench 208 may be formed, for example, by forming a trench etch mask, not shown, over a top surface 216 of the core dielectric layer 206, and removing dielectric material from the core dielectric layer 206 where exposed by the trench etch mask by a reactive ion etch (RIE) process using fluorine radicals, so that a bottom 212 of the trench 208 is located on the trench etch stop layer 204. An etch rate of the trench etch stop layer 204 by the RIE process is significantly lower than an etch rate of the core dielectric layer 206, allowing the RIE process to be terminated after forming the trench 208 before damaging the substrate 202. Forming the trench 208 using the RIE process may produce sides 214 of the trench 208 that are substantially straight and vertical, as depicted in FIG. 2A. In another example, the trench 208 may be formed by a partly isotropic plasma etch process, producing sides 214 which are sloped. In a further example, the trench 208 may be formed by a wet etch process, producing sides 214 which are sloped and have a concave curvature. In a version of the instant example in which the trench etch stop layer 204 is omitted, the trench 208 may be formed by a timed etch process.

An optional trench barrier liner 210 may be formed over the top surface 216 of the core dielectric layer 206, extending into the trench 208 and forming a continuous layer on the sides 214 and bottom 212 of the trench 208. The trench barrier liner 210 may include, for example, silicon nitride, silicon oxynitride, or silicon carbide, or any combination thereof. The trench barrier liner 210 may be formed by one or more PECVD processes, for example as described in reference to the trench etch stop layer 204.

Figure 2B:
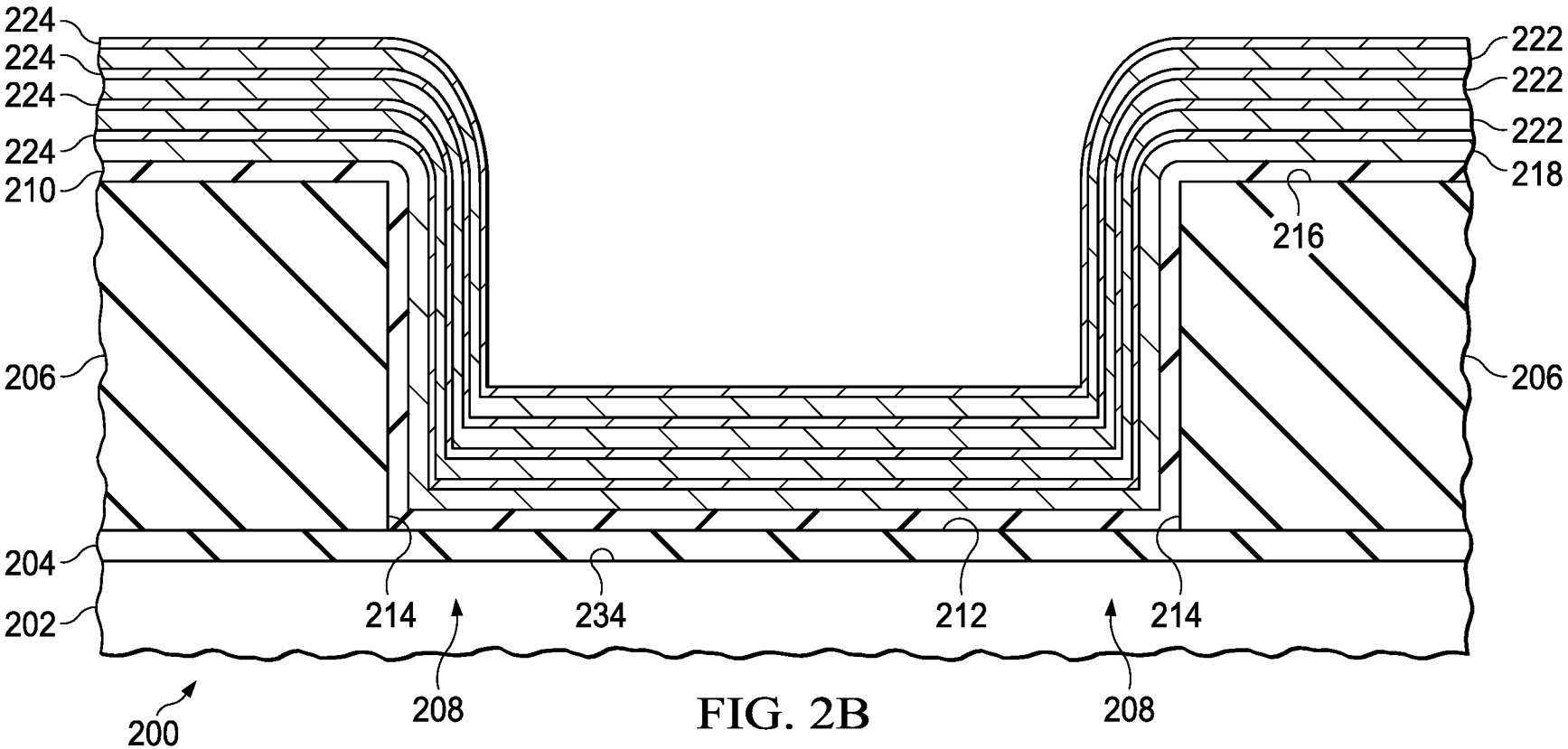

Referring to FIG. 2B, a lower encapsulation layer 218 is formed on the trench barrier liner 210. The lower encapsulation layer 218 may include materials for controlling stress in the subsequently-formed magnetic core 220 shown in FIG. 2E below, such as one or more layers of titanium, titanium nitride, tantalum, tantalum nitride, or any combination thereof. A layer of titanium or a layer of tantalum in the lower encapsulation layer 218 may be formed by a physical vapor deposition (PVD) process, also referred to as a sputter process. A layer of titanium nitride or a layer of tantalum nitride in the lower encapsulation layer 218 may be formed by a PVD process using a nitrogen-containing ambient or by an atomic layer deposition (ALD) process. The lower encapsulation layer 218 is continuous along the sides 214 and bottom 212 of the trench 208.

Magnetic material layers 222 are formed over the lower encapsulation layer 218, extending into the trench 208. The magnetic material layers 222 extend along the sides 214 and the bottom 212 of the trench 208. In the instant example, the magnetic material layers 222 may be alternated with barrier layers 224. The magnetic material layers 222 may include any of the materials described in reference to the magnetic material layers 122 of FIG. 1A and FIG. 1B. Each of the magnetic material layers 222 may be, for example, 10 nanometers to 500 nanometers thick, depending of the specific mode of operation of the integrated magnetic device 200. The barrier layers 224 may include any of the materials described in reference to the barrier layers 124 of FIG. 1A and FIG. 1B. Each of the magnetic material layers 222 may be, for example, 1 nanometers to 20 nanometers thick. The magnetic material layers 222 and the barrier layers 224 may be formed by sequential PVD processes, for example in separate chambers of a cluster tool.

Figure 2C:
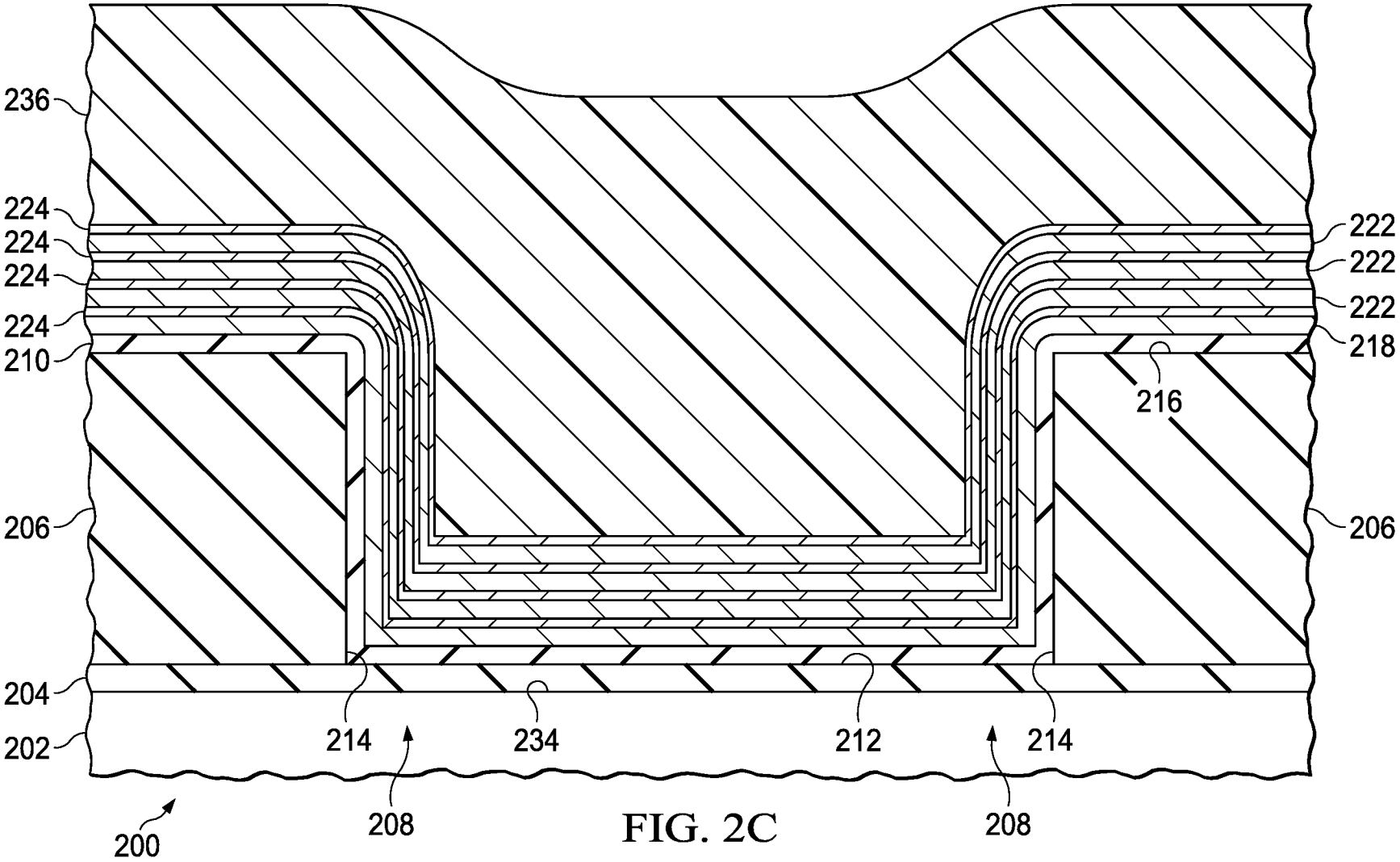

Referring to FIG. 2C, a protective coating 236 is formed over the magnetic material layers 222. A composition of the protective coating 236 may be selected to satisfy two criteria: protection of the magnetic material layers 222 in the trench 208 during a subsequent planarization process, and protection of the magnetic material layers 222 in the trench 208 during a subsequent etch process. The protective coating 236 may have a higher removal rate during the subsequent planarization process than the magnetic material layers 222. The protective coating 236 may include, in one example, organic polymer, such as novolac resin, which may be applied to the integrated magnetic device 100 by a spin-coat process. Other compositions of the protective coating 236, such as spin-on glass (SOG) formulations, silicone polymers, or tape-applied films, are within the scope of the instant example.

Figure 2D:
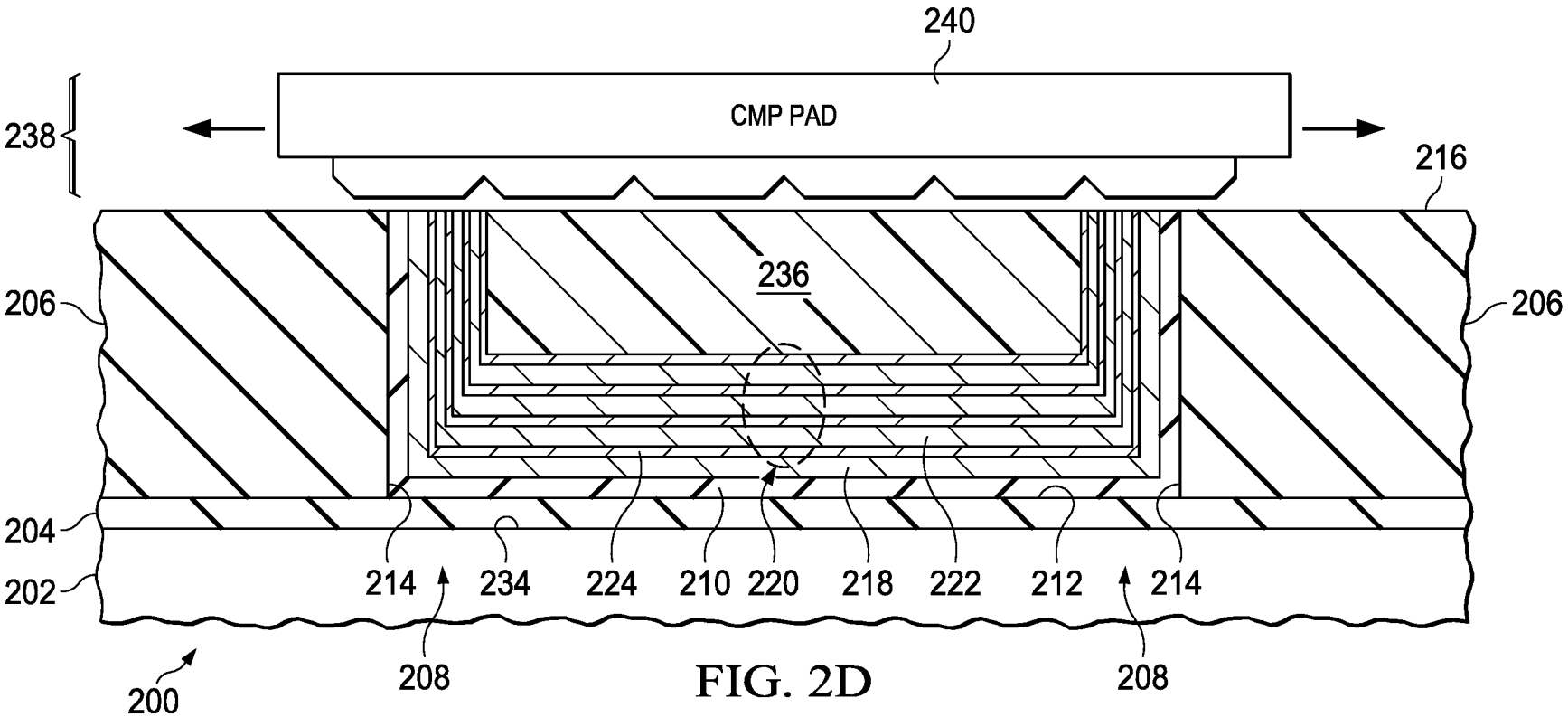

Referring to FIG. 2D, the protective coating 236, the magnetic material layers 222, the barrier layers 224, the lower encapsulation layer 218, and the trench barrier liner 210 are removed from over the top surface 216 of the core dielectric layer 206 by a planarization process 238, which may include a chemical mechanical polish (CMP) process using a CMP pad 240. The CMP process may use an alkaline slurry with a pH value of, for example, 8 to 11. The planarization process 238 may include other planarization steps, such as an etchback step to remove a portion of the protective coating 236 before the CMP process. The planarization process 238 may also remove a portion of the core dielectric layer 206, thus lowering the top surface 216. The CMP process may be an endpointed process or a time process. The magnetic material layers 222 and the barrier layers 224, and the lower encapsulation layer 218, remain in the trench 208, horizontally along the bottom 212 and vertically along the sides 214, after the planarization process 238 is completed. A portion of the protective coating 236 remains over the magnetic material layers 222 in the trench 208.

Figure 2E:
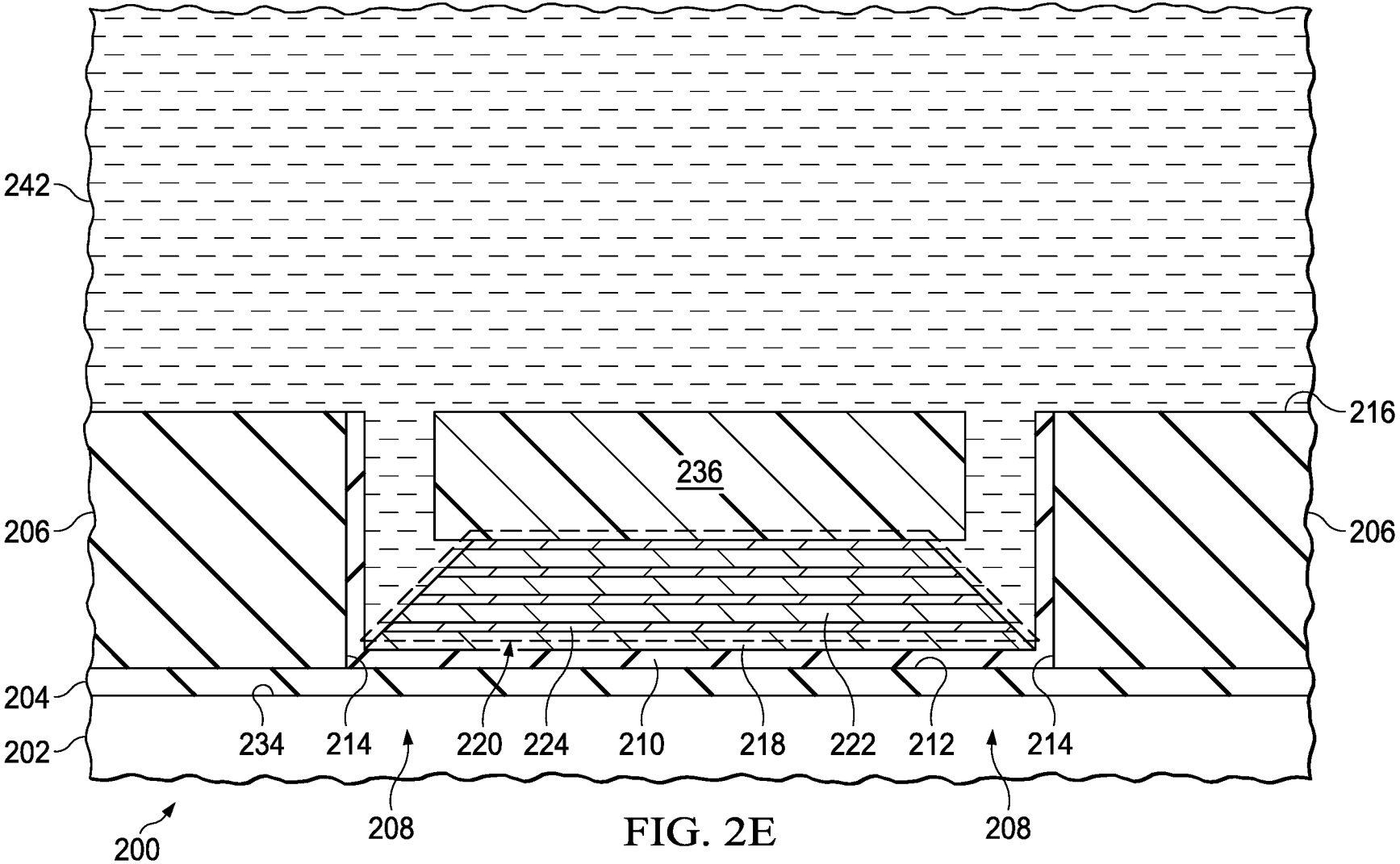

Referring to FIG. 2E, portions of the magnetic material layers 222 and the barrier layers 224 which are located vertically along the sides 214 of the trench 208 are removed by an etch process 242, exemplified in FIG. 2E by a wet etch process 242. The etch process 242 may include an electrochemical etch step in which a positive bias is applied to the magnetic material layers 222 relative to an etchant fluid of the etch process 242. The portion of the protective coating 236 over the magnetic material layers 222 protects the magnetic material layers 222 and the barrier layers 224 which are located horizontally along the bottom 212 of the trench 208. Portions of the lower encapsulation layer 218 which are located vertically along the sides 214 of the trench 208 may optionally be removed by the etch process 242. The wet etch process 242 may include an aqueous solution containing nitric acid, such as an aqueous mixture of nitric acid, acetic acid and phosphoric acid. A composition of the wet etch process 242 may be selected to provide similar etch rates of the magnetic material layers 222 and the barrier layers 224. After the etch process 242 is completed, the protective coating 236 is removed without significant degradation of the magnetic material layers 222. The protective coating 236 may be removed, for example, using a combination of an organic solvent process which dissolves organic resins in the protective coating 236 and an ash process. The magnetic material layers 222 which are located horizontally along the bottom 212 of the trench 208 provide a magnetic core 220 of the integrated magnetic device 200.

Figure 2F:
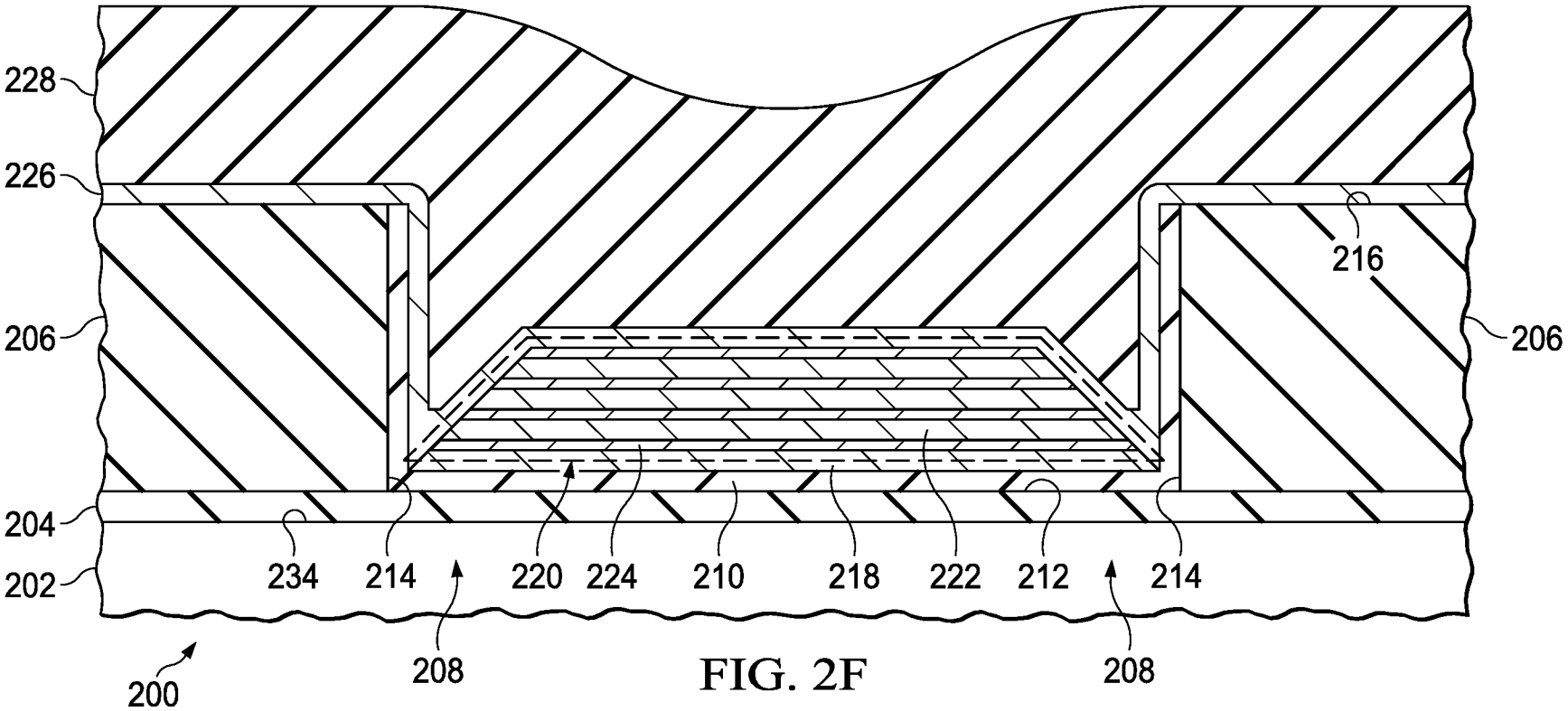

Referring to FIG. 2F, an upper encapsulation layer 226 is formed over the magnetic core 220 and extends up onto the core dielectric layer 206. The upper encapsulation layer 226 may extend along the sides 214 of the trench 208, for example, as depicted in FIG. 2F. The upper encapsulation layer 226 may have a similar composition to the lower encapsulation layer 218, and may be formed by a similar process. The upper encapsulation layer 226 may be thicker than the lower encapsulation layer 218 in order to control stress in the magnetic core 220.

A layer of trench fill material 228 is formed over the upper encapsulation layer 226, filling the trench 208 and extending over the core dielectric layer 206. The layer of trench fill material 228 may be continuous from inside the trench 208 to the core dielectric layer 206, as depicted in FIG. 2F. An upper surface of the trench fill material 228 in the trench 208 may be higher than the top surface 216 of the core dielectric layer 206. The layer of trench fill material 228 may include, for example, one or more layers of silicon nitride or silicon dioxide, or any combination thereof. Silicon dioxide in the layer of trench fill material 228 may be formed by a PECVD process using TEOS. Silicon nitride in the layer of trench fill material 228 may be formed by a PECVD process using silane and ammonia, or BTBAS. A composition and layer structure of the layer of trench fill material 228 may be selected to assist in controlling stress in the magnetic core 220.

Figure 2G:
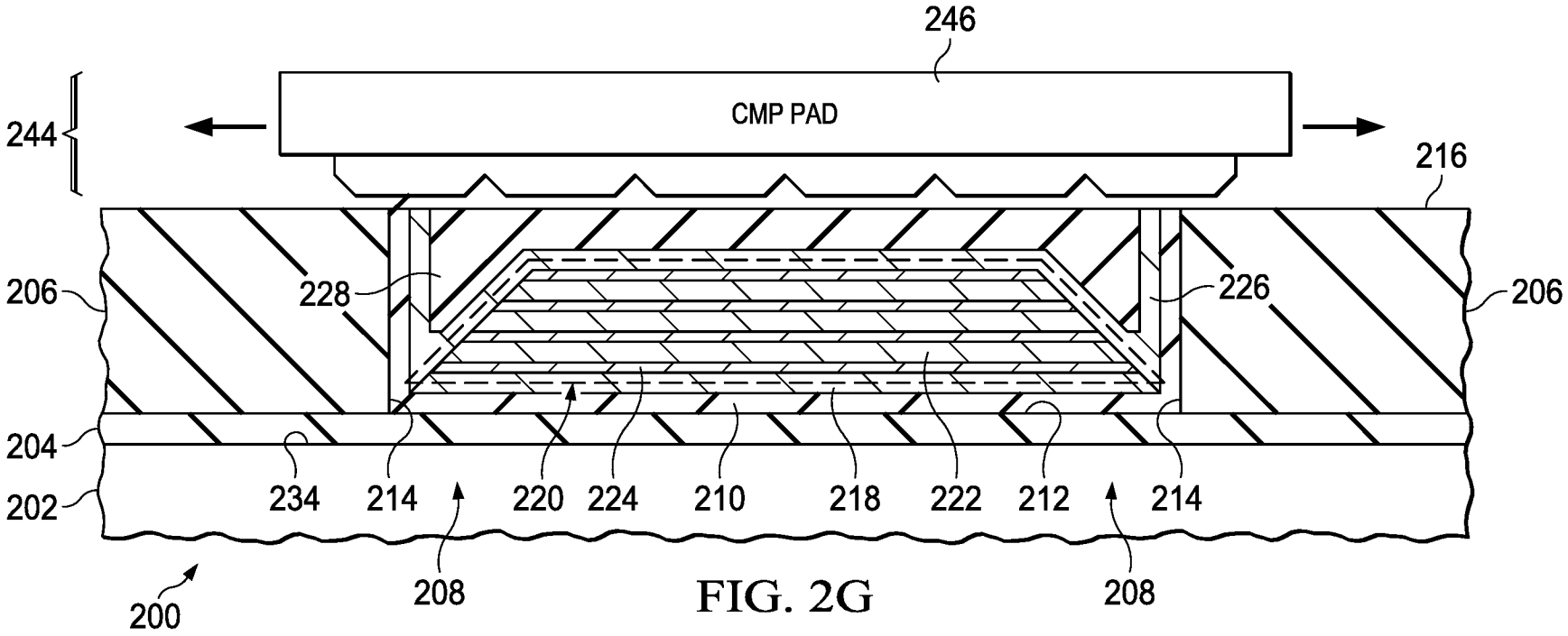

Referring to FIG. 2G, the layer of trench fill material 228 and the upper encapsulation layer 226 are removed from over the top surface 216 of the core dielectric layer 206 by a planarization process 244, which may include a CMP process using a CMP pad 246. The CMP process may use similar chemistry as the CMP process described in reference to FIG. 2D. The planarization process 244 may also remove a portion of the core dielectric layer 206, thus lowering the top surface 216. A portion of the trench fill material 228 remains over the magnetic material layers 222 in the trench 208.

After the planarization process 244 is completed, formation of the integrated magnetic device 200 is continued, for example by forming additional dielectric layers over the core dielectric layer 206 and the trench fill material 228, to provide a structure similar to the integrated magnetic device 100 of FIG. 1A. Other structures for the integrated magnetic device 200 are within the scope of the instant example.

Figure 3A:
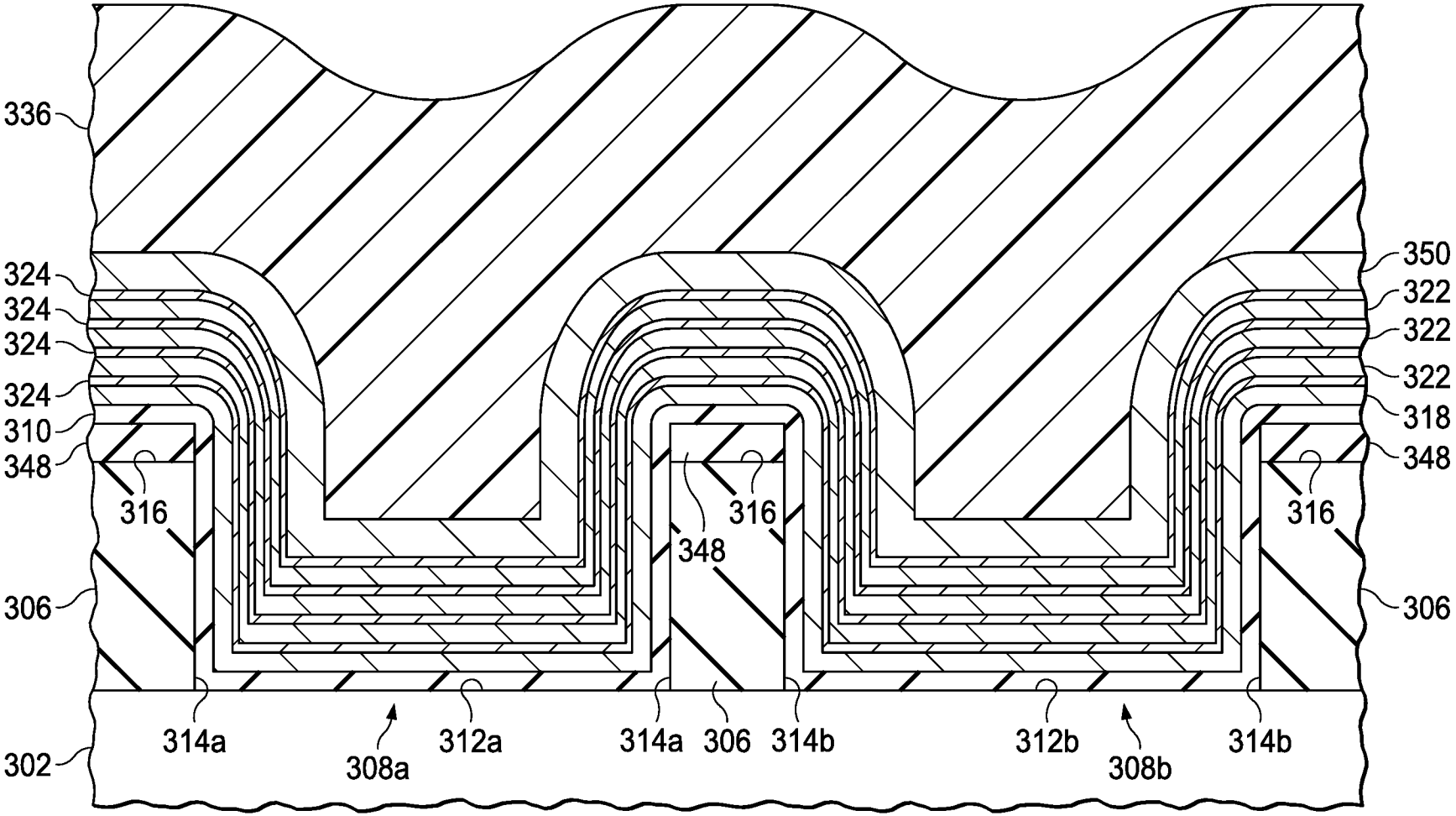
FIGS. 3A through 3E are cross sections of another example integrated magnetic device having a magnetic core located in a trench, depicted in successive stages of another example method of formation.

FIG. 3A through FIG. 3E are cross sections of another example integrated magnetic device having a magnetic core located in a trench, depicted in successive stages of another example method of formation. Referring to FIG. 3A, the integrated magnetic device 300 has a substrate 302 and a core dielectric layer 306 formed over the substrate 302. In one version of the instant example, the core dielectric layer 306 may be an extension of the substrate 302, having a same composition as material of the substrate 302 immediately below the core dielectric layer 306. A CMP stop layer 348 is formed over a top surface 316 of the core dielectric layer 306. The CMP stop layer 348 may include one or more layers of silicon nitride, silicon oxynitride, silicon carbide, or other mechanically hard material with a low removal rate in a subsequent CMP process.

A first trench 308*a* and a second trench 308*b* are formed through the CMP stop layer 348 and extending in the core dielectric layer 306. The trenches 308*a* and 308*b* may extend through the core dielectric layer 306 as depicted in FIG. 3A. A trench barrier liner 310 may optionally be formed over the CMP stop layer 348 and the core dielectric layer 306, extending into the first trench 308*a* and forming a continuous layer on sides 314*a* and a bottom 312*a* of the first trench 308*a*, and extending into the second trench 308*b* and forming a continuous layer on sides 314*b* and a bottom 312*b* of the second trench 308*b*. A lower encapsulation layer 318 may be formed on the trench barrier liner 310. The lower encapsulation layer 318 may have a composition as described in reference to the lower encapsulation layer 118 of FIG. 1A or the lower encapsulation layer 218 of FIG. 2B. The lower encapsulation layer 318 is continuous along the sides 314*a* and 314*b* and the bottoms 312*a* and 312*b* of the trenches 308*a* and 308*b*.

Magnetic material layers 322 are formed over the lower encapsulation layer 318, extending into the trenches 308*a* and 308*b*. The magnetic material layers 322 extend along the sides 314*a* and 314*b* and the bottoms 312*a* and 312*b* of the trenches 308*a* and 308*b*. The magnetic material layers 322 may be alternated with barrier layers 324. The magnetic material layers 322 may include native oxides of the magnetic material layers 322, and may not necessitate separate deposition processes.

In the instant example, a first upper encapsulation layer 350 is formed over the magnetic material layers 322. The first upper encapsulation layer 350 extends into the trenches 308*a* and 308*b*. The first upper encapsulation layer 350 may have a similar composition to the lower encapsulation layer 318.

A protective coating 336 is formed over the first upper encapsulation layer 350. In the instant example, the protective coating 336 may include one or more layers of organic polymer formed by spin coating processes.

Figure 3B:
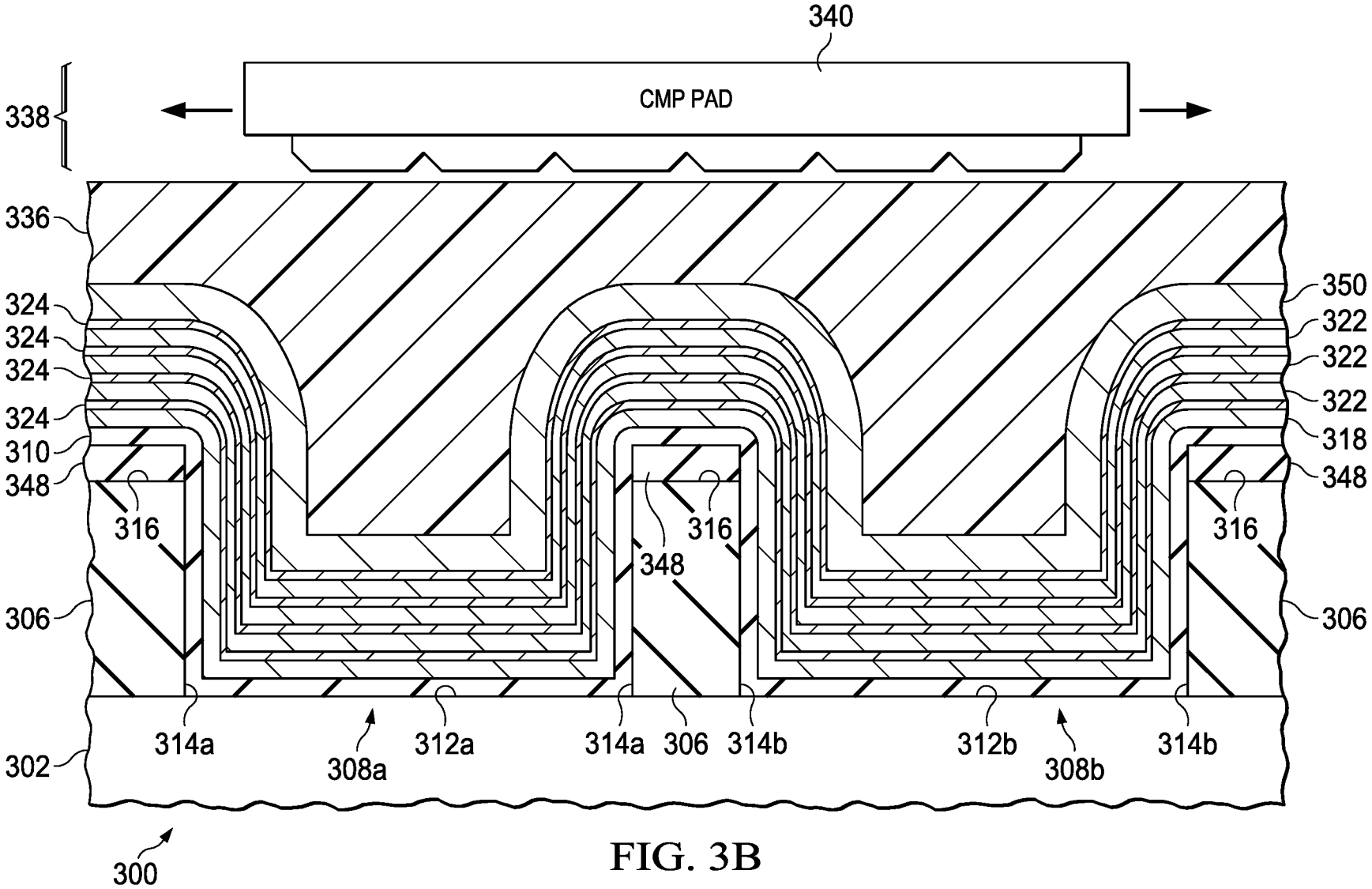

Referring to FIG. 3B, the protective coating 336 is planarized by a planarization process 338. The planarization process 338 may include, for example, a CMP process using a CMP pad 340. The planarization process 338 may also include a leveling bake process before the CMP process. In the instant example, the planarization process 338 may remove a minimum amount of the protective coating 336 necessary to planarized the protective coating 336, leaving the first upper encapsulation layer 350 covered by the protective coating 336.

Figure 3C:
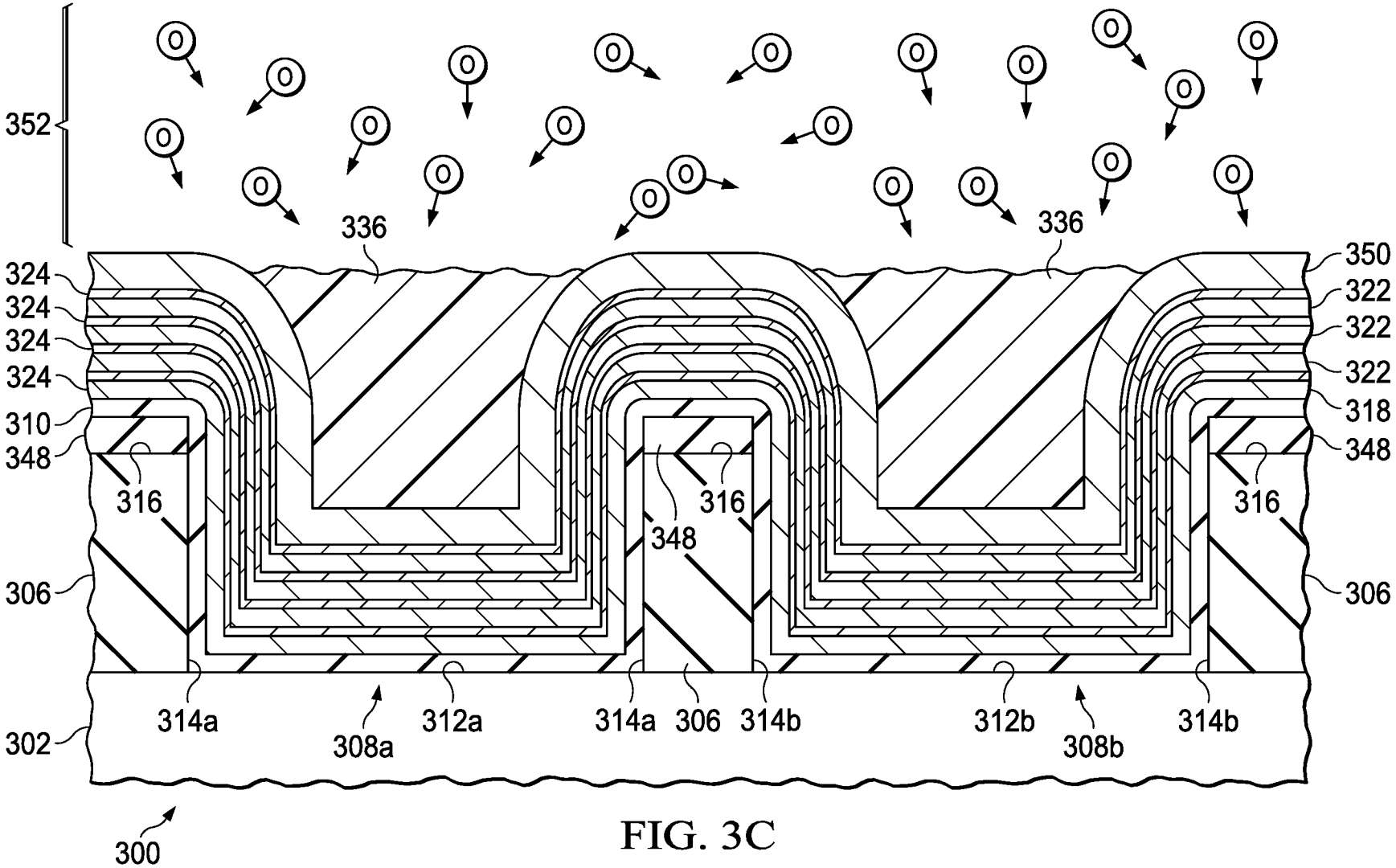

Referring to FIG. 3C, a portion of the protective coating 336 is removed by an isotropic plasma process 352 such as an ash process using oxygen radicals as indicated schematically in FIG. 3B. The isotropic plasma process 352 is continued until a portion of the first upper encapsulation layer 350 is exposed, as depicted in FIG. 3C. A portion of the protective coating 336 remains in the trenches 308*a* and 308*b* on the first upper encapsulation layer 350.

Figure 3D:
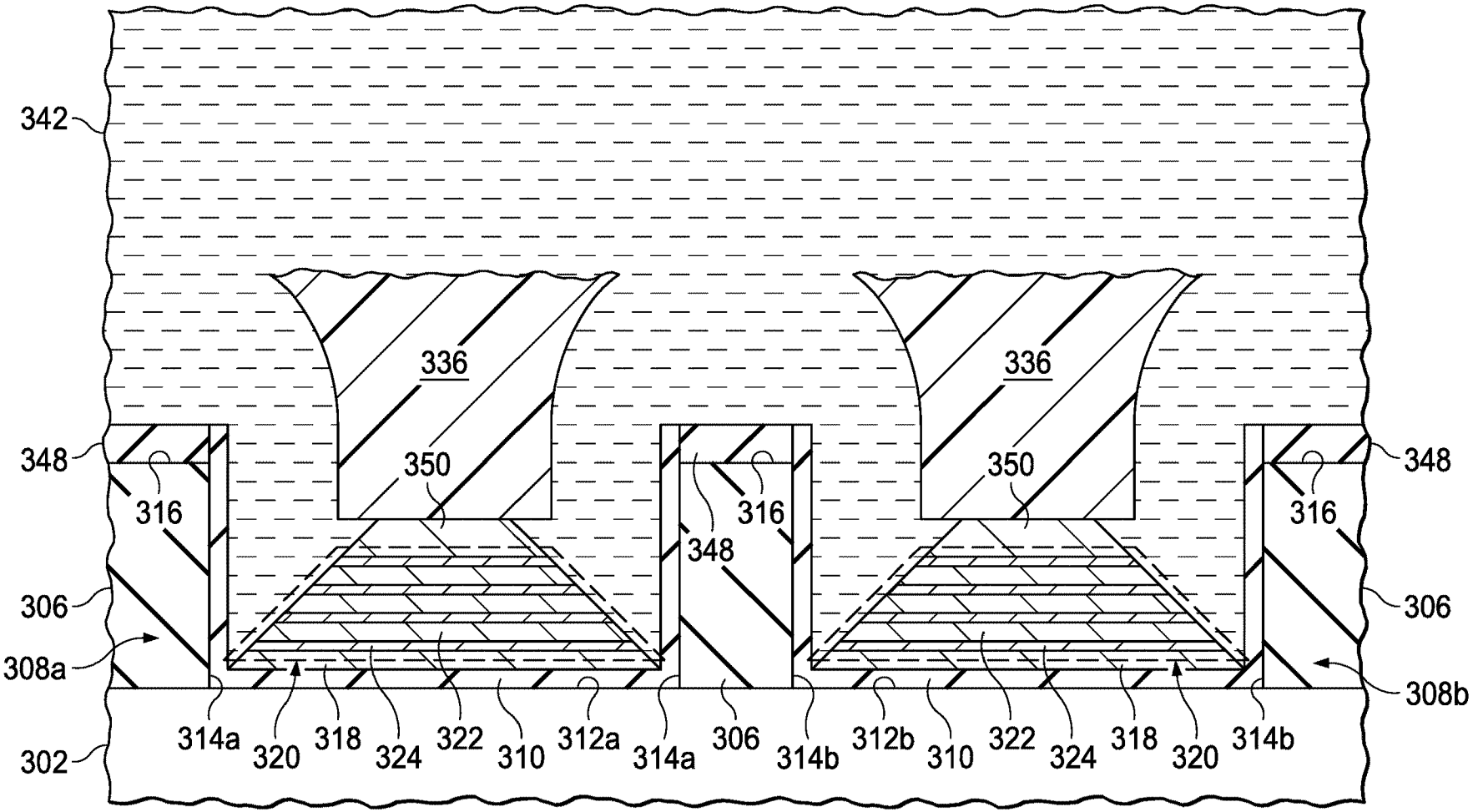

Referring to FIG. 3D, portions of the magnetic material layers 322, and the barrier layers 324 which are located over the top surface 316 of the core dielectric layer 306, and which are located vertically along the sides 314*a* and 314*b* of the trenches 308*a* and 308*b*, are removed by an etch process 342. The etch process 342 may include, for example a wet etch process or an electrochemical process. Portions of the first upper encapsulation layer 350 and the lower encapsulation layer 318 which are located vertically along the sides 314*a* and 314*b* may also be removed by the etch process 342.

The portion of the protective coating 336 over the first upper encapsulation layer 350 protects a portion of the first upper encapsulation layer 350 and the magnetic material layers 322 and the barrier layers 324 which are located horizontally along the bottoms 312*a* and 312*b* of the trenches 308*a* and 308*b*. After the etch process 342 is completed, the protective coating 336 is removed. The magnetic material layers 322 which are located horizontally along the bottoms 312*a* and 312*b* of the trenches 308*a* and 308*b* provide a magnetic core 320 of the integrated magnetic device 300.

Figure 3E:
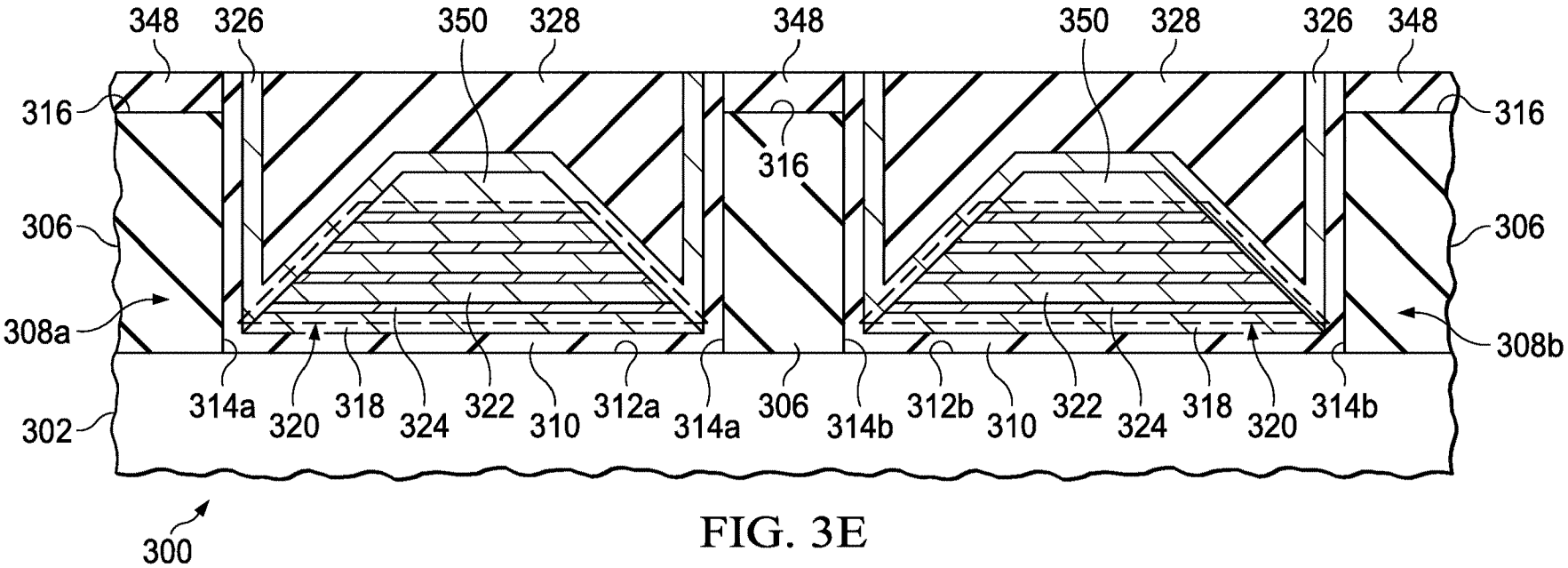

Referring to FIG. 3E, a second upper encapsulation layer 326 is formed over the magnetic core 320 and the remaining portion of the first upper encapsulation layer 350. The second upper encapsulation layer 326 may have a similar composition to the first upper encapsulation layer 350, and may be formed by a similar process. A layer of trench fill material 328 is formed over the second upper encapsulation layer 326, filling the trenches 308*a* and 308*b*. Subsequently, the layer of trench fill material 328 and the second upper encapsulation layer 326 are planarized, for example using a CMP process, to provide an instant top surface of the integrated magnetic device 300 which is flat, extending from the CMP stop layer 348 across the trenches 308*a* and 308*b*. In the instant example, the CMP process may stop on the CMP stop layer 348, advantageously providing a well-controlled depth of the trenches 308*a* and 308*b*. A portion of the trench fill material 328 remains over the magnetic core 320 in the trenches 308*a* and 308*b*. Forming the magnetic core 320 in more the trenches 308*a* and 308*b* may advantageously reduce lateral eddy currents in the magnetic material layers 322 during operation of the integrated magnetic device 300.

Figure 4A:
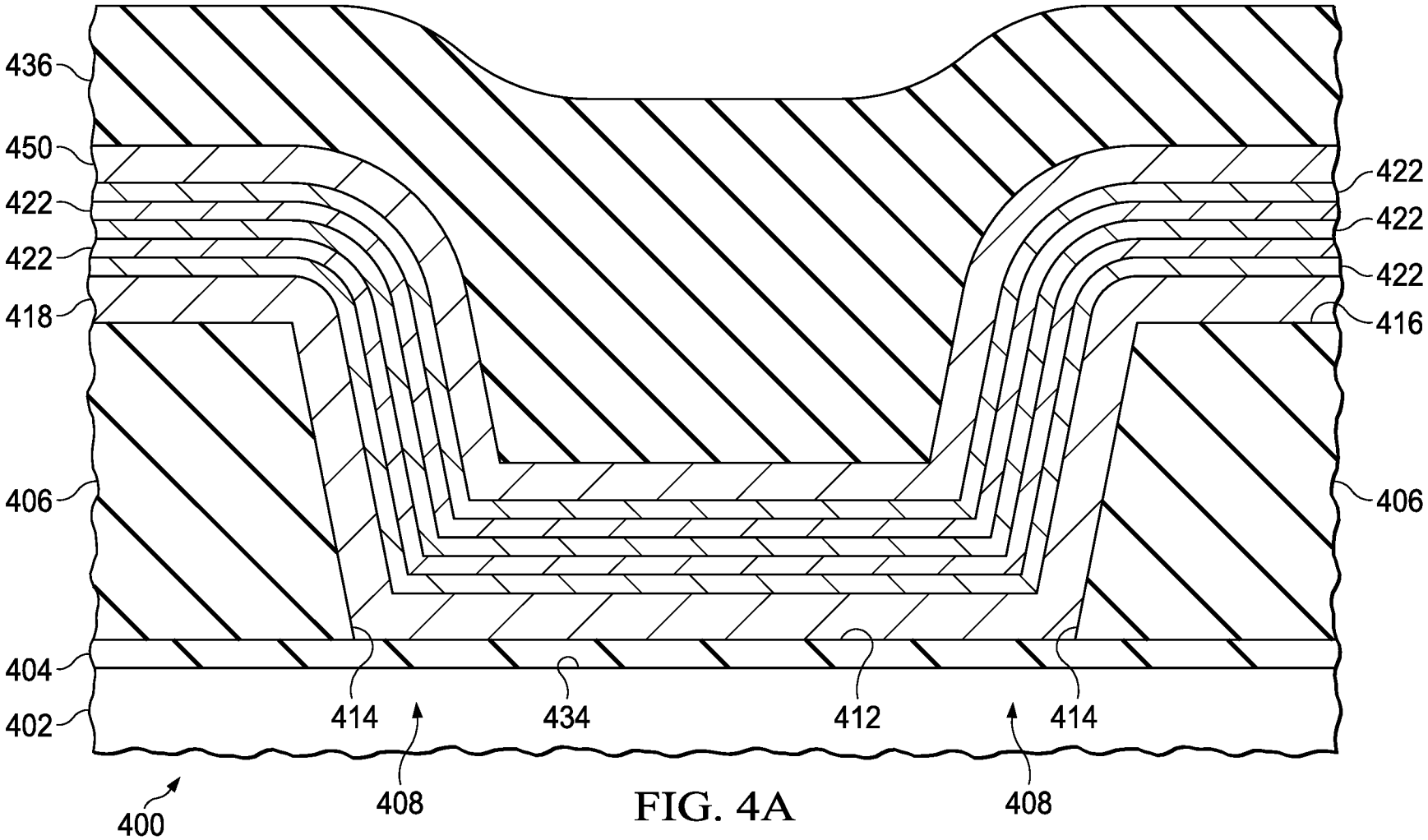
FIGS. 4A through 4D are cross sections of a further example integrated magnetic device having a magnetic core located in a trench, depicted in successive stages of a further example method of formation.

FIG. 4A through FIG. 4D are cross sections of a further example integrated magnetic device having a magnetic core located in a trench, depicted in successive stages of a further example method of formation. Referring to FIG. 4A, the integrated magnetic device 400 has a substrate 402, and may have an optional trench stop layer 404 formed over the substrate 402. A core dielectric layer 406 is formed over the substrate 402, on the trench stop layer 404, if present.

A trench 408 is formed through the core dielectric layer 406 to the trench stop layer 404, if present. In the instant example, the trench 408 may have sloped sides 414 as depicted in FIG. 4A. The sloped sides 414 may be formed using an erodible etch mask. A bottom 412 of the trench 408 is flat and is located on the trench stop layer 404, if present.

A lower encapsulation layer 418 may be formed over a top surface 416 of the core dielectric layer 406, extending into the trench 408. The lower encapsulation layer 418 is continuous along the sides 414 and the bottom 412 of the trench 408. The lower encapsulation layer 418 may have a composition as described in reference to the lower encapsulation layer 118 of FIG. 1A or the lower encapsulation layer 218 of FIG. 2B.

Magnetic material layers 422 are formed over the lower encapsulation layer 418, extending into the trench 408. The magnetic material layers 422 extend along the sides 414 and the bottom 412 of the trench 408. The magnetic material layers 422 may optionally be alternated with barrier layers, not shown in FIG. 4A.

In the instant example, a first upper encapsulation layer 450 is formed over the magnetic material layers 422. The first upper encapsulation layer 450 extends into the trench 408. The first upper encapsulation layer 450 may include palladium, for example.

A protective coating 436 is formed over the first upper encapsulation layer 450. In the instant example, the protective coating 436 may include one or more layers of inorganic dielectric material, such as silicon dioxide, silicon nitride, or any combination thereof.

Figure 4B:
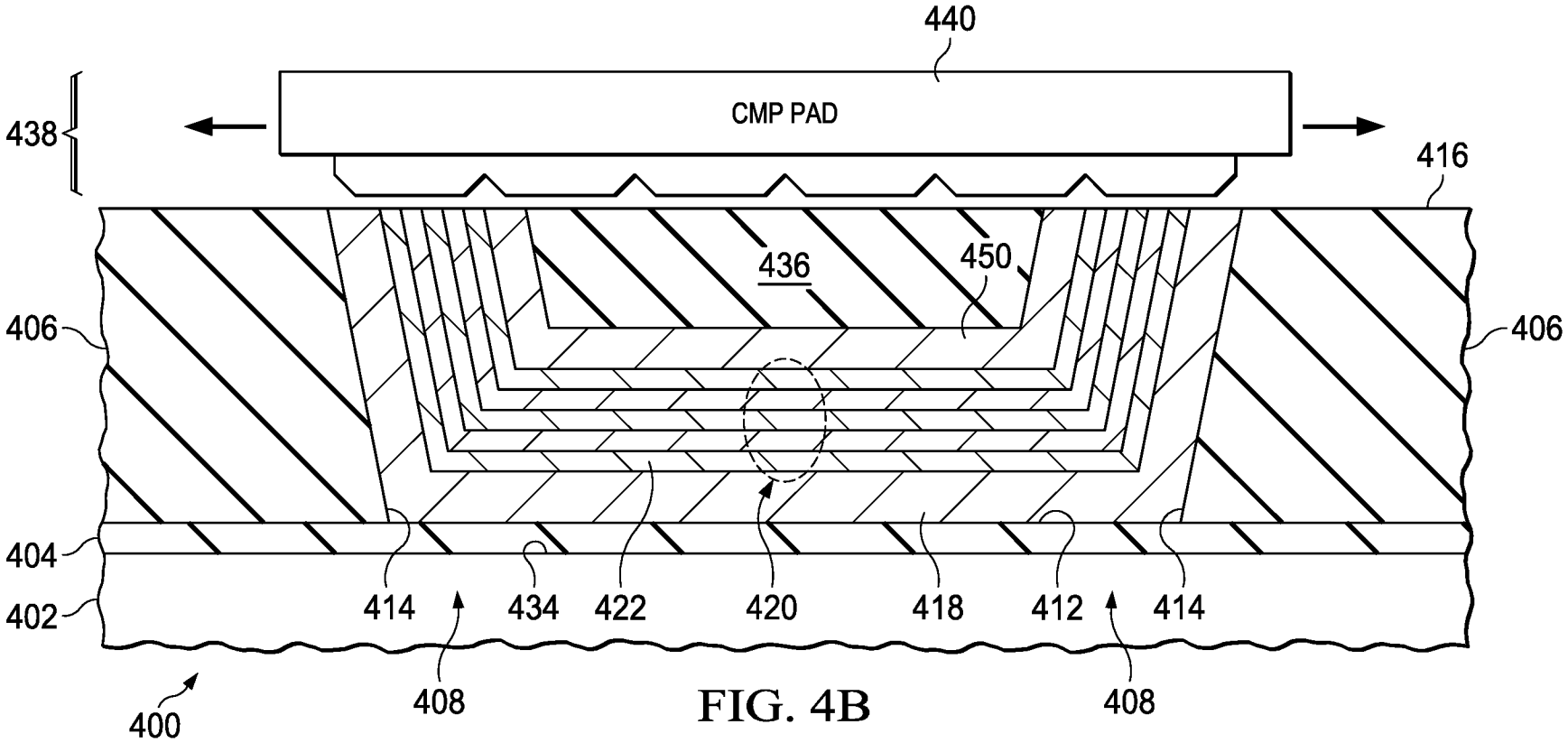

Referring to FIG. 4B, the protective coating 436, the first upper encapsulation layer 450, the magnetic material layers 422, and the lower encapsulation layer 418 are removed from over the top surface 416 of the core dielectric layer 406 by a planarization process 438, which may include a CMP process using a CMP pad 440. The planarization process 438 may also remove a portion of the core dielectric layer 406, thus lowering the top surface 416. The first upper encapsulation layer 450, the magnetic material layers 422, and the lower encapsulation layer 418 remain in the trench 408, horizontally along the bottom 412 and along the sides 414, after the planarization process 438 is completed. A portion of the protective coating 436 remains over the first upper encapsulation layer 450 in the trench 408.

Figure 4C:
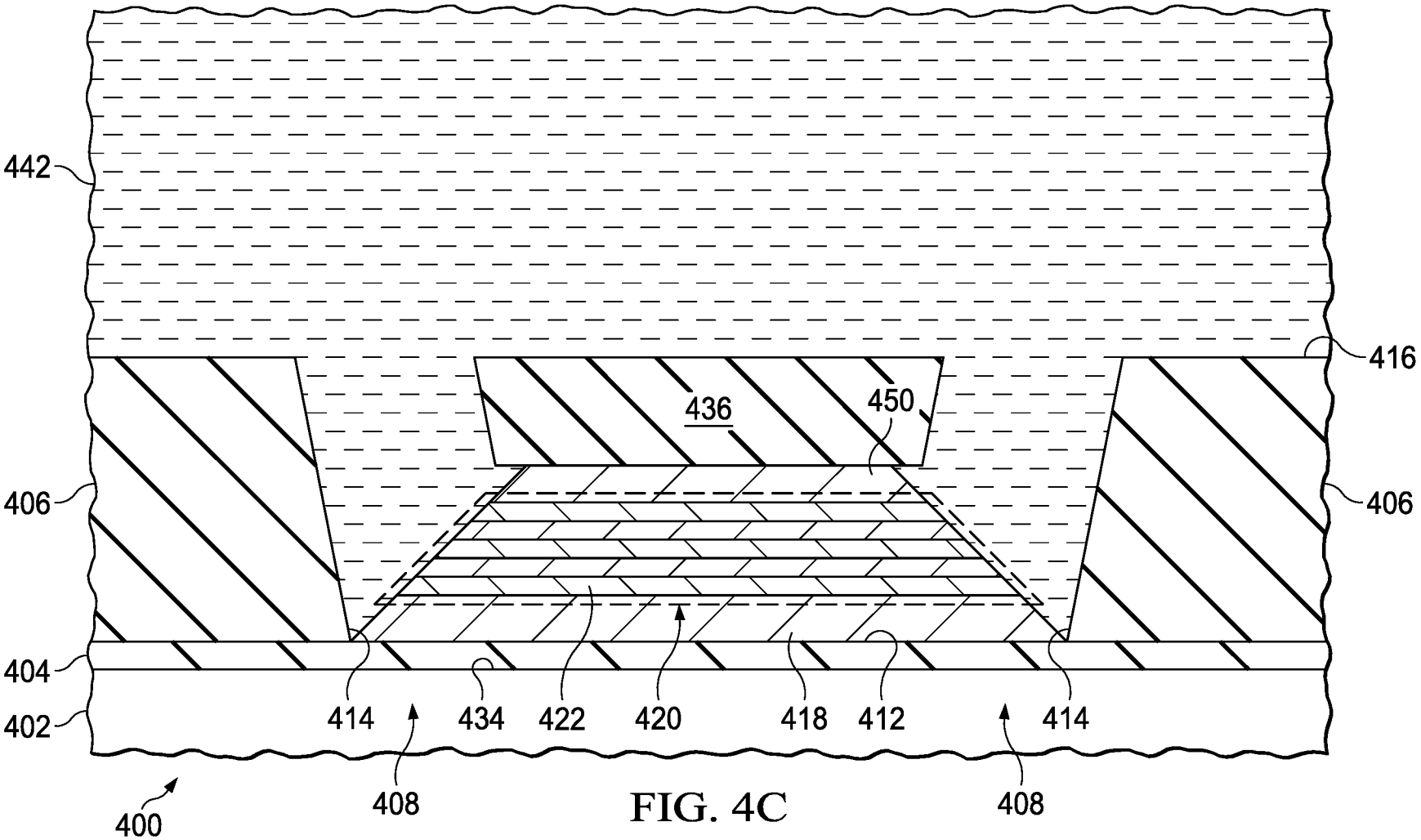

Referring to FIG. 4C, portions of the magnetic material layers 422 which are located along the sides 414 of the trench 408 are removed by an etch process 442. Portions of the first upper encapsulation layer 450 and the lower encapsulation layer 418 which are located along the sides 414 may also be removed by the etch process 442.

The portion of the protective coating 436 over the first upper encapsulation layer 450 protects a portion of the first upper encapsulation layer 450 and the magnetic material layers 422 which are located horizontally along the bottom 412 of the trench 408. In the instant example, after the etch process 442 is completed, the protective coating 436 is left in place. The magnetic material layers 422 which are located horizontally along the bottom 412 of the trench 408 provide a magnetic core 420 of the integrated magnetic device 400.

Figure 4D:
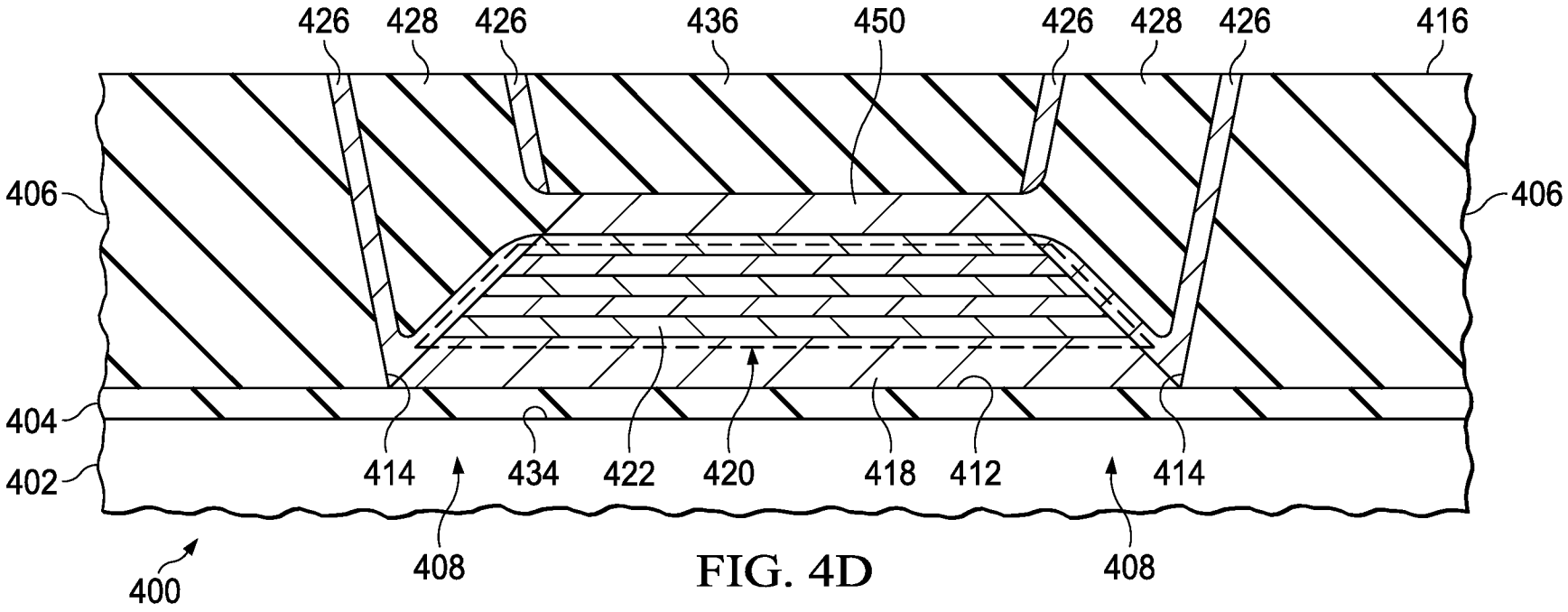

Referring to FIG. 4D, a second upper encapsulation layer 426 is formed over sides of the magnetic core 420 and the sides 414 of the trench 408. The process of forming the second upper encapsulation layer 426 may result in a thin layer of the second upper encapsulation layer 426 being formed on sides of the protective coating 436, as shown in FIG. 4D. The second upper encapsulation layer 426 may have a similar composition to the first upper encapsulation layer 450, or may have a different composition to better control stress in the magnetic core 420. A layer of trench fill material 428 is formed over the core dielectric layer 406 and over the protective coating 436, filling the trench 408. Subsequently, the layer of trench fill material 428 and the second upper encapsulation layer 426 are removed from over the top surface 416 of the core dielectric layer 406, for example using a CMP process. A portion of the protective coating 436 and a portion of the trench fill material 428 remain in the trench 408. Using the portion of the protective coating 436 as a permanent part of the integrated magnetic device 400 may advantageously reduce fabrication cost and complexity.

While various embodiments of the present disclosure have been described above, it should be understood that they have been presented by way of example only and not limitation. Numerous changes to the disclosed embodiments can be made in accordance with the disclosure herein without departing from the spirit or scope of the disclosure. Thus, the breadth and scope of the present invention should not be limited by any of the above described embodiments. Rather, the scope of the disclosure should be defined in accordance with the following claims and their equivalents.

What is claimed is:

1. An integrated magnetic device, comprising:

a substrate;

a trench structure adjacent to the substrate;

a magnetic core in the trench structure, the magnetic core having a top surface and a bottom surface between the top surface and the substrate, the bottom surface wider than the top surface;

an upper dielectric layer disposed over the magnetic core; and a core dielectric layer over the substrate, the trench substrate being located in the core dielectric layer, the trench structure having sides and a bottom.

2. The integrated magnetic device of claim 1, wherein:

the magnetic core includes magnetic material layers that are flat and parallel to a bottom of the trench structure; and the magnetic material layers include a metal selected from the group consisting of iron, nickel, and cobalt.

3. The integrated magnetic device of claim 2, wherein the magnetic core includes barrier layers alternating with the magnetic material layers.

4. The integrated magnetic device of claim 1, further comprising a lower encapsulation layer in the trench structure under the magnetic core.

5. The integrated magnetic device of claim 4, wherein the lower encapsulation layer includes a material selected from the group consisting of titanium, titanium nitride, tantalum, and tantalum nitride.

6. The integrated magnetic device of claim 1, further comprising an upper encapsulation layer in the trench structure over the magnetic core.

7. The integrated magnetic device of claim 6, wherein the upper encapsulation layer includes a material selected from the group consisting of titanium, titanium nitride, tantalum, tantalum nitride, and palladium.

8. The integrated magnetic device of claim 1, wherein:

the trench structure is a first trench structure, and further comprising a second trench structure adjacent to the substrate; and the magnetic core is also located in the second trench structure, below an opening of the second trench structure.

9. An electromagnetic device, comprising:

an opening within a core dielectric layer of a first dielectric material, the core dielectric layer having a top surface and side surfaces within the opening; and a magnetic core within the opening, the magnetic core having a core top surface located below the dielectric layer top surface and having a first width, and sloped sidewalls that slope from the top surface towards the side surfaces to a bottom core surface located between the top surface and a device substrate and having a second width greater than the first width, wherein the magnetic core layer includes magnetic material layers, adjacent ones of the magnetic material layers being separated by a barrier layer.

10. The device of claim 9, further comprising a protective coating over the side surfaces, the top surface of the magnetic core layer, and the sloped sidewalls of the magnetic core layer.

11. The device of claim 9, further comprising a layer of trench fill material within the opening and over the magnetic core layer.

12. The device of claim 9, further comprising a dielectric layer of a second different dielectric material that touches the core dielectric layer within the opening, an encapsulation layer over the magnetic core layer, and a fill material within the opening.

13. The device of claim 12, further comprising a barrier lined located between the core dielectric layer and the magnetic core layer, wherein the barrier liner covers the sidewalls and underlies the magnetic core layer.

14. The device of claim 13, further comprising a dielectric layer of a second different dielectric material that touches the core dielectric layer within the opening, the barrier liner, an encapsulation layer over the magnetic core layer, and a fill material within the opening.

15. The device of claim 9, wherein the magnetic core layer has a trapezoidal section profile.

16. An integrated magnetic device, comprising:

a substrate;

a first trench structure and a second trench structure adjacent to the substrate, the first trench structure adjacent the second trench structure;

a magnetic core having a first magnetic core portion in the first trench structure and a second magnetic core portion in the second trench structure, each magnetic core portion having a top surface and a wider bottom surface; and an upper dielectric layer disposed over the magnetic core.

17. The integrated magnetic device of claim 16, wherein the substrate comprises a semiconductor material.

18. An integrated magnetic device, comprising:

a substrate;

a trench structure adjacent to the substrate;

a magnetic core in the trench structure, the magnetic core having a top surface and a bottom surface between the top surface and the substrate, the bottom surface wider than the top surface;

an upper dielectric layer disposed over the magnetic core, wherein the magnetic core includes magnetic material layers that are flat and parallel to a bottom of the trench structure; and the magnetic material layers includes a metal selected from the group consisting of iron, nickel, and cobalt.

19. An integrated magnetic device, comprising:

a substrate;

a trench structure adjacent to the substrate;

a magnetic core in the trench structure, the magnetic core having a top surface and a bottom surface between the top surface and the substrate, the bottom surface wider than the top surface;

an upper dielectric layer disposed over the magnetic core; and a lower encapsulation layer in the trench structure under the magnetic core.

20. An integrated magnetic device, comprising:

a substrate;

a trench structure adjacent to the substrate;

a magnetic core in the trench structure, the magnetic core having a top surface and a bottom surface between the top surface and the substrate, the bottom surface wider than the top surface;

an upper dielectric layer disposed over the magnetic core; and an upper encapsulation layer in the trench structure over the magnetic core.

21. An integrated magnetic device, comprising:

a substrate;

a trench structure adjacent to the substrate;

a magnetic core in the trench structure, the magnetic core having a top surface and a bottom surface between the top surface and the substrate, the bottom surface wider than the top surface;

an upper dielectric layer disposed over the magnetic core, wherein the trench structure is a first trench structure, and further comprising a second trench structure adjacent to the substrate; and the magnetic core is also located in the second trench structure, below an opening of the second trench structure.

22. An electromagnetic device, comprising:

an opening within a core dielectric layer of a first dielectric material, the core dielectric layer having a top surface and side surfaces within the opening; and a magnetic core within the opening, the magnetic core having a core top surface located below the dielectric layer top surface and having a first width, and sloped sidewalls that slope from the top surface towards the side surfaces to a bottom core surface located between the top surface and a device substrate and having a second width greater than the first width; and a dielectric layer of a second different dielectric material that touches the core dielectric layer within the opening, an encapsulation layer over the magnetic core layer, and a fill material within the opening.

23. An electromagnetic device, comprising:

an opening within a core dielectric layer of a first dielectric material, the core dielectric layer having a top surface and side surfaces within the opening; and a magnetic core within the opening, the magnetic core having a core top surface located below the dielectric layer top surface and having a first width, and sloped sidewalls that slope from the top surface towards the side surfaces to a bottom core surface located between the top surface and a device substrate and having a second width greater than the first width; and a barrier line located between the core dielectric layer and the magnetic core layer, wherein the barrier liner covers the sidewalls and underlies the magnetic core layer.

* * * * *